United States Patent [19]

Britz et al.

[11] Patent Number: 5,068,492

[45] Date of Patent: Nov. 26, 1991

[54] CONTAINER HAVING A HOT WALL WITH A HIGH-TEMPERATURE-TOLERANT CURRENT PASS-THROUGH

[75] Inventors: Lothar Britz, Hauset, Belgium; Wolfgang Krug; Johann Seferiadis, both of Jülich, Fed. Rep. of Germany

[73] Assignee: Forschungzentrum Jülich GmbH, Jülich, Fed. Rep. of Germany

[21] Appl. No.: 479,085

[22] Filed: Feb. 12, 1990

[30] Foreign Application Priority Data

Feb. 13, 1989 [DE] Fed. Rep. of Germany ..... 3904195

[51] Int. Cl.[5] ..... H01B 17/30

[52] U.S. Cl. ..... 174/31.5; 174/151

[58] Field of Search ..... 174/17.06, 18, 31 R, 174/31.5, 151, 152 R, 152 GM; 373/36, 37, 95, 147, 148, 156, 157, 163, 166

[56] References Cited

U.S. PATENT DOCUMENTS 2,942,615 6/1960 Dayton ..... 137/248

4,512,791 4/1985 Kyle ..... 174/152 GM X

FOREIGN PATENT DOCUMENTS 1640012 7/1970 Fed. Rep. of Germany ..... 174/18

7512782 9/1975 Fed. Rep. of Germany .

*Primary Examiner*—Laramie E. Askin

*Attorney, Agent, or Firm*—Frishauf, Holtz, Goodman & Woodward

[57] ABSTRACT

A current pass-through arrangement for a rodlike electrode passing substantially perpendicularly through a hot wall of a container features an inner seal and an outer seal, with the outer seal located at a substantially cooler position than the hot wall. Preferably, a portion of the electrode is tightly fitted into a cylindrical bushing of electrically insulating material. The electrode projects out of this bushing, at least at the container-adjacent end. In turn, the bushing is tightly fitted into a wall element (4) having a smaller-diameter end and a larger-diameter end which is sealed into the container wall. The wall element (4) and the electrode centered within it define an annular space which is at least partly filled with sealing material (5). According to a further embodiment, the electrode also projects from the container-remote end of the bushing (3). An open-topped cylindrical vessel (6) concentrically surrounds the projection electrode and defines another space at least partly filled with sealing material. This sealing material surrounds the container-remote end of the wall element (4).

6 Claims, 2 Drawing Sheets

CONTAINER HAVING A HOT WALL WITH A HIGH-TEMPERATURE-TOLERANT CURRENT PASS-THROUGH

FIELD OF THE INVENTION

The present invention relates generally to current supply pass-throughs for containers, and, more particularly, to an improved seal structure which withstands high temperatures, pressure differences, and corrosive atmospheres.

BACKGROUND

The leak-free passage of electrical current into a container with hot walls, at temperatures upwards of 550° C., particularly in a corrosive atmosphere, is a technical problem which heretofore has not been solved.

Such current supply pass-throughs are required, for example, in crystal-drawing apparatus with closed, heated containers, in which a crucible heater has to be supplied with current.

BRIEF DESCRIPTION OF THE INVENTION

It is an object of the invention to provide a current pass-through of the aforementioned kind which enables leak-free and electrically insulated passage of electrical current into the container, even if the temperature in the container exceeds 550° C.

Briefly, this is accomplished by tightly fitting a rod-like electrode within an insulating bushing, connecting the bushing to the container wall with a stepped-diameter wall element which defines an annular space between itself and the electrode, and filling the annular space with a stable sealing material such as boron oxide.

It has been found that the current pass-through of the present invention has an exceedingly low leakage rate when appropriate sealing materials are used, so that even the micro-crevices between the components of the current pass-through do not have adverse effects.

Particularly advantageous is the incorporation of liquid boron oxide ($B_2O_3$) as sealing material, since it is not only electrically insulating, but also substantially stable chemically and thermally, and has a low vapor pressure. Due to its high viscosity, $B_2O_3$ seals off micro-crevices well without having to directly penetrate these crevices. As sealing material, one could also use, for example, hafnium fluoride ($HfF_4$) or zirconium fluoride ($ZrF_4$).

A further feature of the invention is that the electrode projects from the bushing not only at the container-adjacent end, but also at the container-remote end, where it is concentrically surrounded by an open-topped cylindrical vessel filled with more sealing material. The vessel contains so much sealing material that the outermost portion of the wall element is submerged in the sealing material.

According to a further preferred feature, the electrode, the bushing, and the wall element of the current pass-through are dimensioned such that, when the interior of the container is 500° C. or more, the outer ends of the current pass-through fall in a temperature range below 100° C. The lower end of the wall element is gas-tightly and electrically insulatingly connected to the electrode by means of conventional current pass-throughs or a sealing material, e.g. an adhesive designed to withstand temperatures up to 100° C.

BRIEF FIGURE DESCRIPTION

The current pass-through of the present invention is schematically illustrated in the following drawings, of which:

FIG. 1 is a current pass-through, with two containers for receiving sealing or caulking material; and FIG. 2 is view, partially in section, of a current pass-through, with sealing in the form of a standard current pass-through or feed-through.

DETAILED DESCRIPTION

Figure 1:
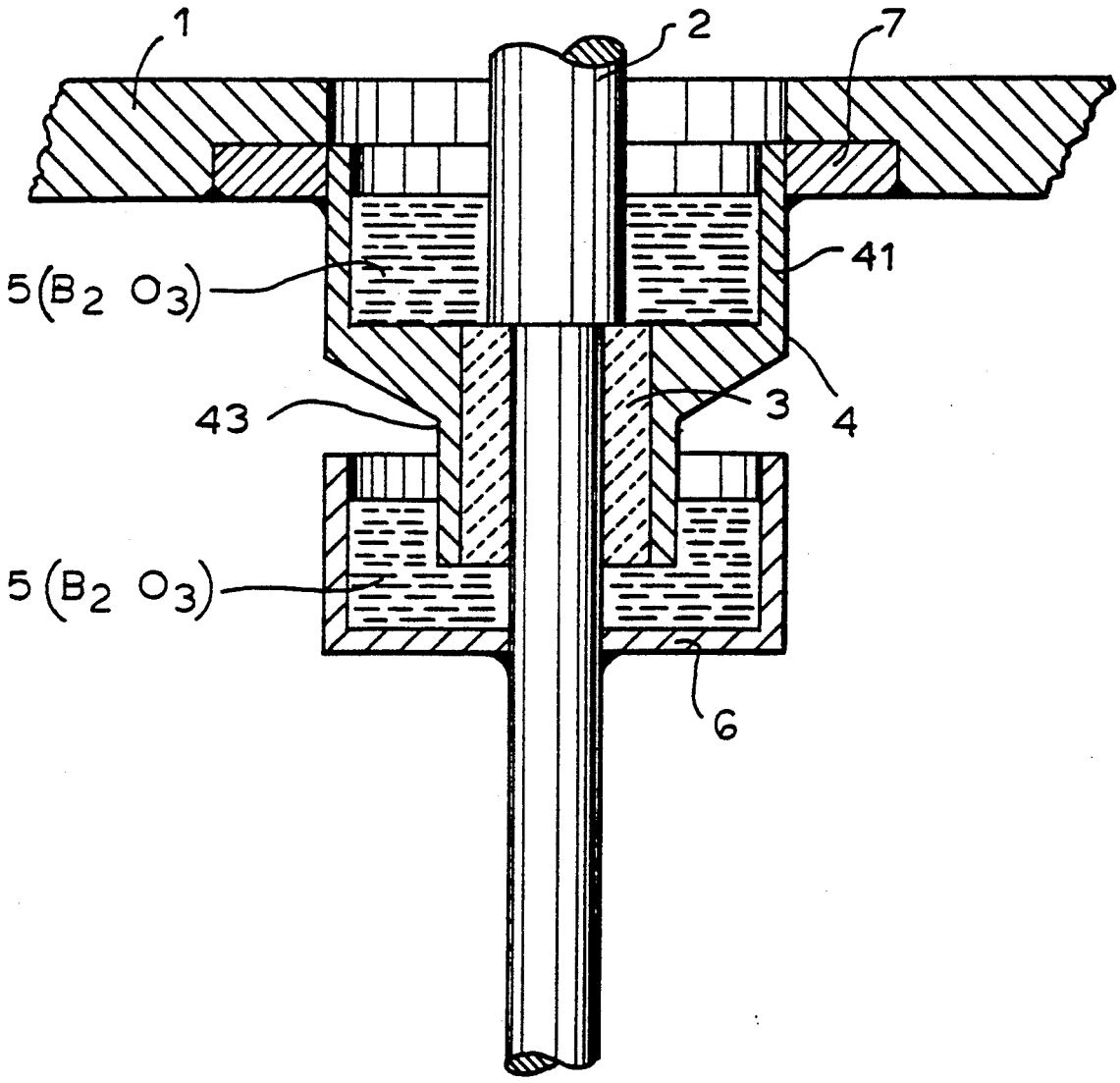

FIG. 1 illustrates a current pass-through for a receptacle or container with a hot wall 1. An electrode 2 passes through wall 1. Electrode 2 is partly fitted tightly into a cylindrical insulating sleeve or bushing 3 of $Al_2O_3$ (aluminum oxide). The upper end of the electrode consists essentially of graphite and projects out of bushing 3. Bushing 3 is tightly fitted into a generally stepped-cylindrical, outwardly extending wall element 4 of receptacle wall 1. A larger-diameter end 41 of wall element 4, between receptacle wall 1 and bushing 3, defines between itself and electrode 2 a generally annular cavity which is mostly filled with an appropriate sealing material 5.

A smaller-diameter end 43 of wall element 4 projects radially outward from receptacle wall 1 and into a generally annular space defined by an open-ended cylindrical vessel 6 which is secured concentrically about electrode 2. Vessel 6 is also partly filled with sealing material 5, to the extent that the lower end of wall element 4 is submerged in or surrounded by sealing material 5.

The larger-diameter end of wall element 4 is sealed to a circumferential flange 7 which, in turn, is sealed in a rabbet of receptacle or container wall 1. This current pass-through, when boron oxide is used as sealing material, has been found to function trouble-free in the temperature range between 500° C. and 700° C. Even with pressure differences, between the upper and lower ends of the pass-through, of up to 2 bar (atmospheres), the leakage rates had values below $10^{-7}$ millibars per second.

Figure 2:
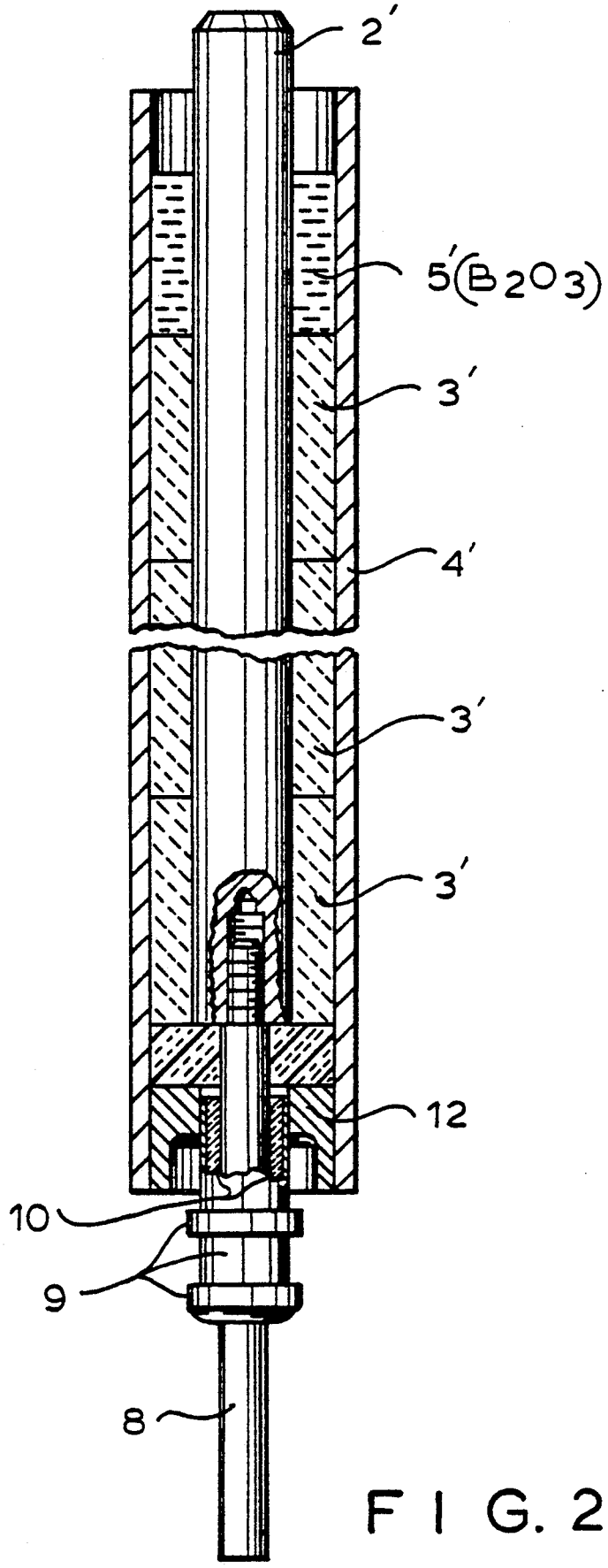

FIG. 2 illustrates an alternate embodiment, in which the sealing of the current pass-through is achieved by the incorporation of a conventional current pass-through. Elements analogous to those of FIG. 1 have been designated with the same reference numerals, only primed. In the schematically abbreviated graphic representation of the current pass-through, electrode 2' is tightly fitted into the cylindrical insulating bushings 3'. The upper end of electrode 2' defines, together with wall 4' surrounding bushings 3', a generally annular space above the uppermost bushing, which space is partly filled with sealing material 5'.

The conventional current pass-through comprises an electrode 8, a wall 9 with a double-ringed outer surface and an insulating ring 10. Electrode 8 is externally threaded and screws into electrode 2', which is internally threaded. A metallic connecting piece 12, secured to wall 4', concentrically surrounds electrode 8 and insulating ring 10 and defines an annular space into which wall 9 is soldered or welded.

Various changes and modifications are possible within the scope of the inventive concept.

We claim:

1. High-temperature-tolerant current pass-through in combination with a container with a hot wall (1)

through which a rodlike electrode (2) passes substantially perpendicularly to said wall, wherein a generally cylindrical bushing (3) of electrically insulating material is tightly fitted around said electrode (2);

said electrode (2) projects out of said bushing (3) at least at a container-adjacent end of said bushing;

said bushing (3) is tightly fitted into a concentrically surrounding wall element (4) having a pair of ends of differing diameters, a larger-diameter end of said element being sealed to said hot wall (1), said larger-diameter end defining between itself and said electrode a generally annular cavity which is at least partly filled with sealing material (5) which will tolerate a temperature of at least 500° C.

2. The combination according to claim 1, wherein said electrode (2) also projects from a container-remote end of said bushing (3), and further comprising an open-ended container (6) secured about said electrode and defining between its outer periphery and said electrode (2) a space which is filled with sealing material (5), said sealing material overlapping a smaller-diameter end of said wall element (4).

3. The combination of claim 1, wherein said sealing material consists essentially of hafnium fluoride.

4. The combination of claim 1, wherein said sealing material consists essentially of zirconium fluoride.

5. High-temperature-tolerant current pass-through in combination with a container with a hot wall (1) through which a rodlike electrode (2) passes substantially perpendicularly to said wall, wherein a generally cylindrical bushing (3) of electrically insulating material is tightly fitted around said electrode (2);

said electrode (2) projects out of said bushing (3) at least at a container-adjacent end of said bushing;

said bushing (3) is tightly fitted into a concentrically surrounding wall element (4) having a pair of ends of differing diameters, a larger-diameter end of said element being sealed to said hot wall (1), said larger-diameter end defining between itself and said electrode a generally annular cavity which is at least partly filled with sealing material (5); and said sealing material consists essentially of boron oxide.

6. High-temperature-tolerant current pass-through in combination with a container with a hot wall (1) through which a rodlike electrode (2') passes substantially perpendicularly to said wall, wherein a generally cylindrical bushing (3') of electrically insulating material is tightly fitted around said electrode (2');

said electrode (2') projects out of said bushing (3') at least at a container-adjacent end of said bushing;

said bushing (3') is tightly fitted into a concentrically surrounding wall element (4'), a container-adjacent end of said wall element being sealed to said hot wall (1) and defining between itself and said electrode (2') a generally annular cavity adjacent said bushing (3'), which cavity is at least partly filled with sealing material (5') which will tolerate a temperature of at least 500° C.;

a container-remote end of said electrode (2') projects from said bushing (3');

said electrode, bushing, and wall element are dimensioned such that, when an interior temperature of said container is in the range between 500° C. and 700° C., a container-remote end of said bushing (3') and said wall element (4') will be at a temperature below 100° C., and a lower end of said wall element (4') is gas-tightly and electrically insulatingly secured to said electrode.

* * * * *